US007742360B1

(12) United States Patent
Price

(10) Patent No.: US 7,742,360 B1
(45) Date of Patent: Jun. 22, 2010

(54) DATE-IDENTIFYING CONTAINER FOR PERISHABLE FOOD ITEMS

(76) Inventor: John R. Price, 1224 Williamsburg Dr., Northbrook, IL (US) 60062

( * ) Notice: Subject to any disclaimer, the term of this patent is extended or adjusted under 35 U.S.C. 154(b) by 0 days.

(21) Appl. No.: 11/442,725

(22) Filed: May 30, 2006

(51) Int. Cl.
*G09F 9/00* (2006.01)

(52) U.S. Cl. ..... 368/10; 116/308

(58) Field of Classification Search ..... 368/10; 116/308, 318, 322; 206/459.1, 459.5; 215/200–215, 215/230

See application file for complete search history.

(56) References Cited

U.S. PATENT DOCUMENTS 1,687,956 A 10/1928 Trask
2,817,451 A * 12/1957 Giles et al. ..... 215/230
2,921,553 A * 1/1960 Luenberger ..... 116/308
4,482,068 A * 11/1984 Agbay et al. ..... 215/225
4,619,221 A 10/1986 Linstromberg
5,335,509 A 8/1994 Namisniak et al.
D401,526 S 11/1998 Stunder
D417,167 S 11/1999 Stunder
6,817,192 B2 11/2004 Ector, Jr. et al.

* cited by examiner

*Primary Examiner*—Vit W Miska
*Assistant Examiner*—Sean Kayes

(57) ABSTRACT

A combined container and date-notification mechanism includes a container that has a body and a lid removably attached thereto for maintaining the perishable food item isolated from the environment. A mechanism is included for identifying a date when the perishable food item is placed inside the body such that a user can quickly identify a number of days that the perishable food has been housed within the container without removing the lid from the body. An identification marker is adjustably connected to the date-identifying mechanism and is spaced from the affixing mechanism. A mechanism is included for removably affixing the date-identifying mechanism onto the lid such that the user can selectively affix the date-identifying mechanism onto alternate containers. The affixing mechanism is formed from water insoluble material.

1 Claim, 7 Drawing Sheets

DATE-IDENTIFYING CONTAINER FOR PERISHABLE FOOD ITEMS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to food containers and, more particularly, to a date-identifying container for perishable food items.

2. Prior Art

Many food stuff, including fresh and frozen foods, have a use-by-date after which the item is no longer safe or suitable for human consumption. Should a person accidentally consume food that has expired they become susceptible to food poisoning and various other ailments, like gastro-intestinal discomfort and diarrhea, to name only a few. Although the food items are sold in packages and containers that have the use-by-date printed thereon, a consumer does not always keep the food stuff in the container or package that is was bought in.

Thus, a person may store food in the refrigerator or in a cupboard in a conventional container, like a plastic bowl with a lid, while discarding the original container that the product was bought in. As time progresses a user may forget what the use-by-date of a particular food item was. Unfortunately, when this occurs, people tend to simply discard the food so as not to run the risk of becoming sick from spoiled food stuff. This can become a very expensive practice if food, which is expensive, is repeatedly thrown in the trash due to the uncertainty of its use-by-date.

Accordingly, a need remains for a date-identifying container for perishable food items in order to overcome the above-noted shortcomings. The present invention satisfies such a need by providing food container that is convenient and easy to use, is versatile in its applications, is light-weight and durable in design, and eliminates the unfortunate possibility of a person eating or serving spoiled food. Such a container allows a user to indicate the date, in clear and easy to read manner, when the food stuff within the container is no longer safe for consumption. Advantageously, the container can be used to store fresh and frozen foods, alike. Persons find use for such a container both at home and in commercial establishments, like restaurants, delis and food catering businesses, to name a few.

BRIEF SUMMARY OF THE INVENTION

In view of the foregoing background, it is therefore an object of the present invention to provide a date-identifying container for perishable food items. These and other objects, features, and advantages of the invention are provided by a combined container and date-notification mechanism for identifying a freshness date of a perishable food item stored within the container.

The combined container and date-notification mechanism includes a container that has a body and a lid removably attached to the body for advantageously and effectively maintaining the perishable food item isolated from the environment.

A mechanism is included for identifying a date when the perishable food item is placed inside the body such that a user can conveniently quickly identify a number of days that the perishable food has been housed within the container without removing the lid from the body. Such a date-identifying mechanism preferably includes a first rotatable disc that has an outer band displaying numeric indicia thereon in a sequential pattern ranging from the numerals 1-12. Each of the numerals identifies a month in a calendar year. A linear shaft has a top end directly and statically coupled to the first rotatable disc and protrudes downwardly therefrom.

A second rotatable disc is statically coupled directly to a bottom end of the shaft such that the second rotatable disc is disposed subjacent to the first rotatable disc. Such first and second rotatable discs rotate in sync when the user rotates the first rotatable disc. The second rotatable disc has an outer band displaying numeric indicia thereon in a sequential pattern ranging from the numerals 1-31. Each of the second rotatable disc numerals identifies a day in a calendar month. Such second rotatable disc numerals are outwardly spaced from the first rotatable disc numerals such that the user can conveniently visually identify the first rotatable disc numerals and at least one second rotatable disc numerals from a top plan view.

The date-identifying mechanism may further include a first stationary disc that is coextensively shaped with the second rotatable disc. Such a first stationary disc is intercalated between the first and second rotatable discs such that first stationary disc effectively covers an entire surface area of the second rotatable disc. The first stationary disc has an annular opening formed along an outer edge thereof such that the annular opening effectively becomes aligned with the second rotatable disc numerals. A second stationary disc is statically conjoined to the top surface of the lid. Such a second stationary disc is directly coupled to the first stationary disc in such a manner that the first and second stationary discs remain affixed at a static position while the first and second rotatable discs are rotated. The second rotatable disc is intercalated between the first and second stationary discs.

A mechanism is included for removably affixing the date-identifying mechanism onto the lid such that the user can advantageously selectively affix the date-identifying mechanism onto alternate containers. Such an affixing mechanism is formed from water insoluble material. The affixing mechanism preferably includes an adhesive layer that is directly conjoined to a bottom surface of the second stationary disc. Such an adhesive layer has a peelable protective cover attached thereto.

An identification marker is adjustably connected to the date-identifying mechanism. Such an identification marker is spaced from the affixing mechanism.

In an alternate embodiment, the date-identifying mechanism preferably includes first and second rectilinear bars that are juxtaposed side-by-side and extend across a major width of the lid. Such first and second rectilinear bars have a plurality of numerals imprinted thereon in sequential order for effectively and conveniently identifying the days in a calendar month. A third rectilinear bar is spaced from the first and second rectilinear bars. Such a third rectilinear bar is directly conjoined to the lid and has a plurality of numerals imprinted thereon in sequential order for identifying the months in a calendar year.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
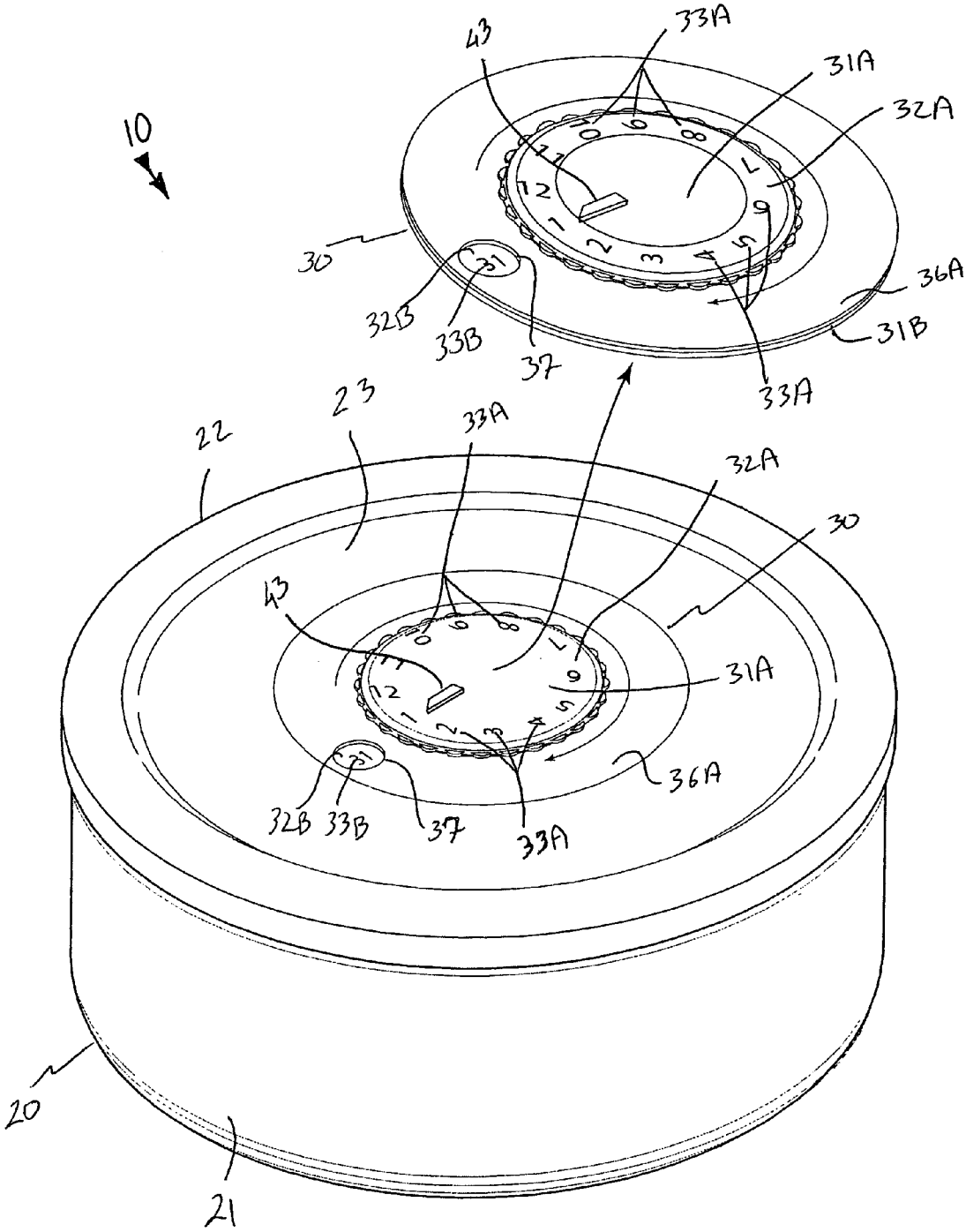
FIG. 1 is a perspective view showing a date-identifying container for perishable food items, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-10 by the reference numeral 10 and is intended to provide a date-identifying container for perishable foods. It should be understood that the apparatus 10 may be used to store many different types of perishable goods and should not be limited in use to only storing food stuff.

Figure 2:
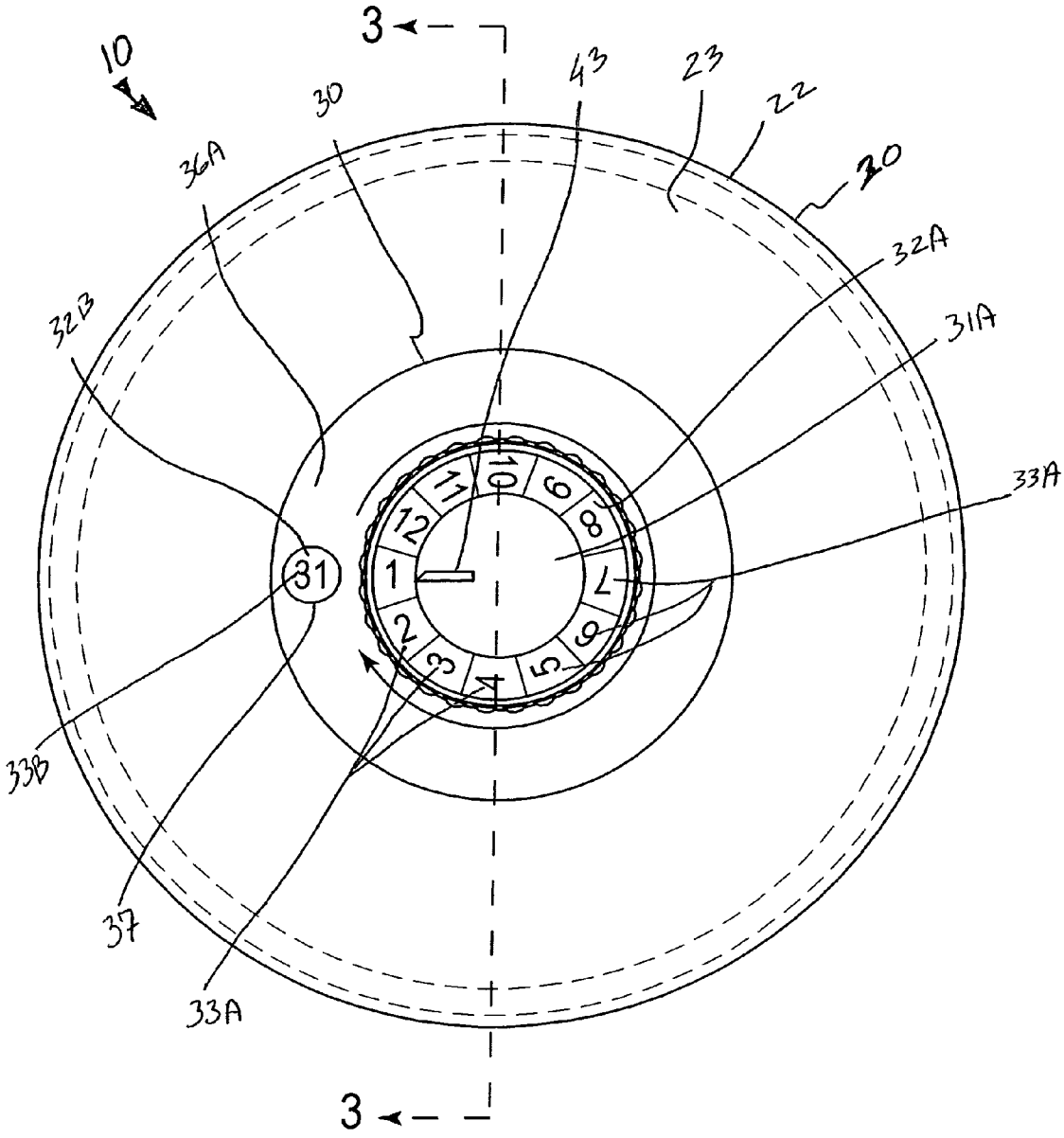
FIG. 2 is a top plan view of the apparatus shown in FIG. 1.
Figure 3:
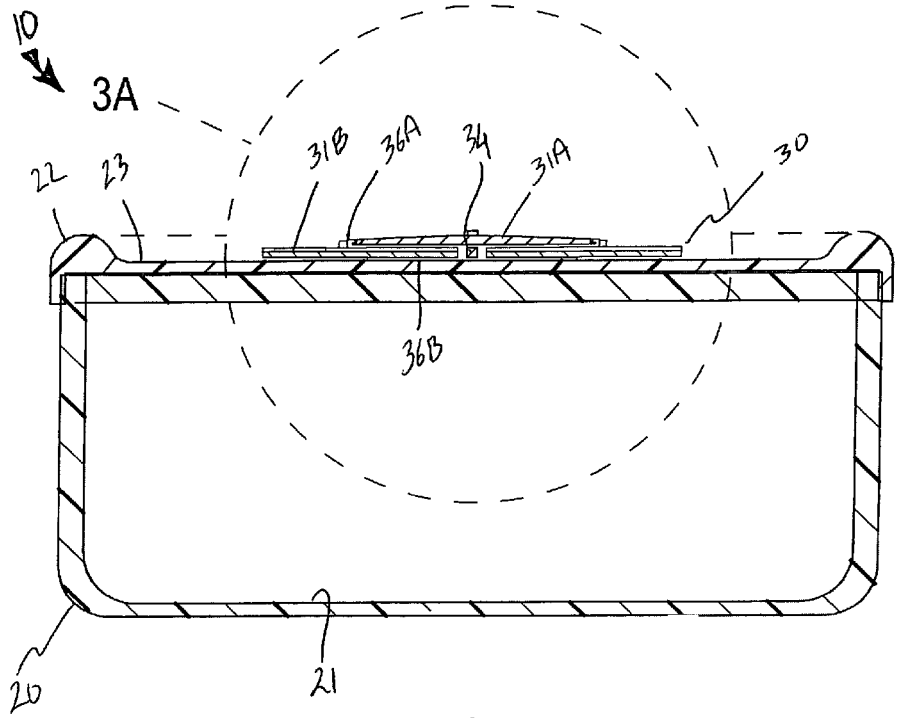
FIG. 3 is a cross-sectional view of the apparatus shown in FIG. 2, taken along line 3-3.

Referring initially to FIGS. 1, 2 and 3, the apparatus 10 includes a container 20 that has a body 21 and a lid 22 removably attached to the body 21, which is crucial for advantageously and effectively maintaining the perishable food item isolated from the environment. Of course, the body 21 and the lid 22 may be produced in a variety of alternate shapes, sizes and colors, as is obvious to a person of ordinary skill in the art. Of course, the container 20 may be used for storing fresh and/or frozen food items, as well as other types of perishable goods, as is obvious to a person of ordinary skill in the art.

Figure 3A:
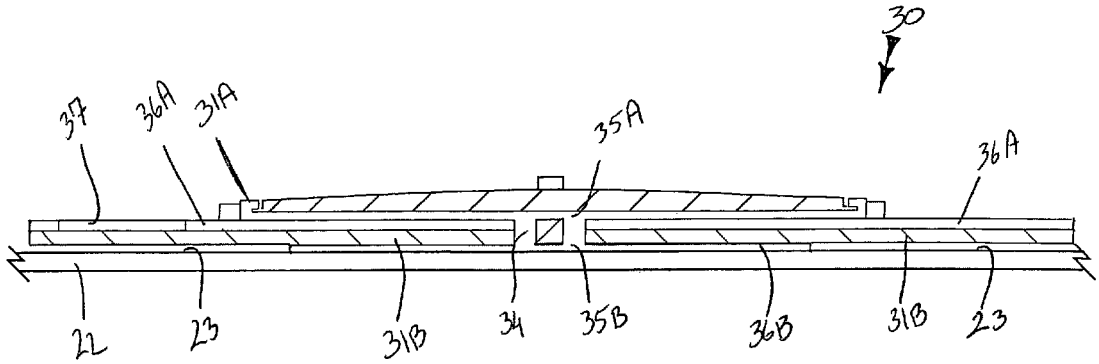
FIG. 3A is an enlarged view of section 3A as indicated in FIG. 3.
Figure 4A:
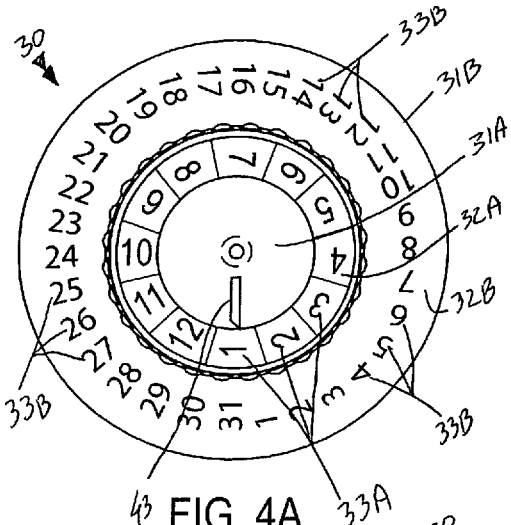
FIG. 4A is a top plan view of the first and second rotatable discs shown in FIG. 4.
Figure 5A:
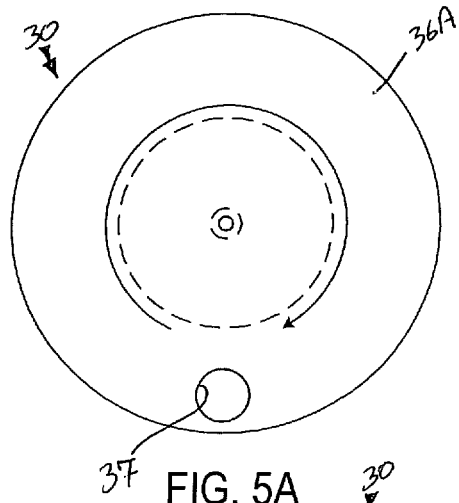
FIG. 5A is a top plan view of the first and second stationary discs shown in FIG. 5.
Figure 4:
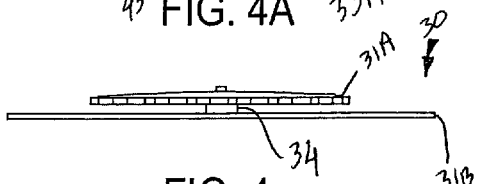
FIG. 4 is a side-elevational view of the first and second rotatable discs shown in FIG. 1.
Figure 5:
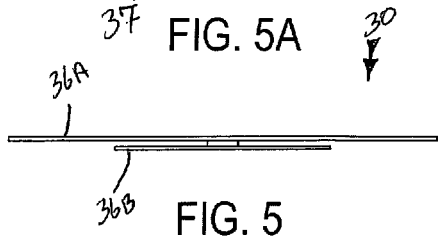
FIG. 5 is a side-elevational view of the first and second stationary discs shown in FIGS. 1 and 3A.
Figure 6:
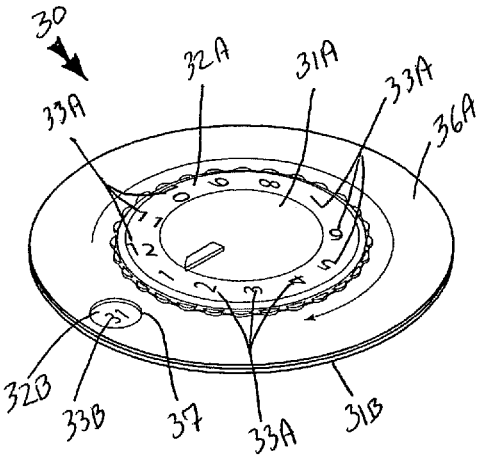
FIG. 6 is a perspective view of the date-identifying mechanism shown in FIG. 1.

Referring to FIGS. 1 through 7, a mechanism 30 is included for conveniently identifying a date when the perishable food item is placed inside the body 21 such that a user can conveniently quickly identify a number of days that the perishable food has been housed within the container 20 without removing the lid 22 from the body 21. Such a date-identifying mechanism 30 includes a first rotatable disc 31A that has an outer band 32A displaying numeric indicia 33A thereon in a sequential pattern ranging from the numerals 1-12. Each of the numerals 33A identifies a month in a calendar year. A linear shaft 34 has a top end 35A directly and statically coupled, without the use of intervening elements, to the first rotatable disc 31A and protrudes downwardly therefrom, as is best shown in FIGS. 3A and 4.

Again referring to FIGS. 1 through 7, a second rotatable disc 31B is statically coupled directly, without the use of intervening elements, to a bottom end 35B of the shaft 34 such that the second rotatable disc 31B is disposed subjacent to the first rotatable disc 31A. Such first 31A and second 31B rotatable discs rotate in sync when the user rotates the first rotatable disc 31A. The second rotatable disc 31B has an outer band 32B displaying numeric indicia 33B thereon in a sequential pattern ranging from the numerals 1-31. Each of the second rotatable disc numerals 33B identifies a day in a calendar month. Such second rotatable disc numerals 33B are outwardly spaced from the first rotatable disc numerals 33A such that the user can conveniently visually identify the first rotatable disc numerals 33A and at least one of the second rotatable disc numerals 33B from a top plan view, as is best shown in FIG. 2.

Referring to FIGS. 1, 2, 3, 3A, 5, 5A, 6 and 7, the date-identifying mechanism 30 further includes a first stationary disc 36A that is coextensively shaped with the second rotatable disc 31B. Such a first stationary disc 36A is intercalated between the first 31A and second 31B rotatable discs such that the first stationary disc 36A effectively covers an entire surface area of the second rotatable disc 31B. The first stationary disc 36A has an annular opening 37 formed along an outer edge thereof such that the annular opening 37 effectively becomes aligned with the second rotatable disc numerals 33B. A second stationary disc 36B is statically conjoined to the top surface 23 of the lid 22. Such a second stationary disc 36B is directly coupled, without the use of intervening elements, to the first stationary disc 36A in such a manner that the first 36A and second 36B stationary discs remain affixed at a static position while the first 31A and second 31B rotatable discs are rotated. The second rotatable disc 31B is intercalated between the first 36A and second 36B stationary discs.

Figure 7:
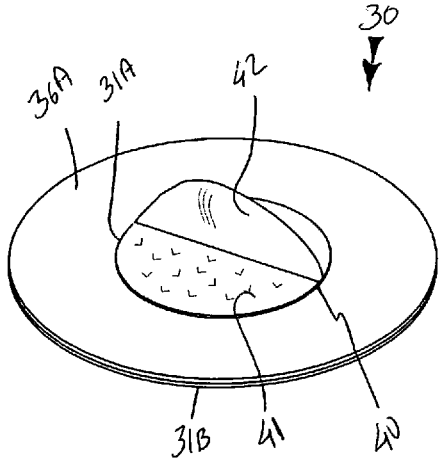
FIG. 7 is a perspective view showing the affixing mechanism, in accordance with the present invention.

Referring to FIG. 7, a mechanism 40 is included for removably affixing the date-identifying mechanism 30 onto the lid 22, which is crucial such that the user can advantageously selectively affix the date-identifying mechanism 30 onto alternate containers 20. Such an affixing mechanism 40 is formed from water insoluble material, which is an important feature for allowing the apparatus 10 to be employed in moist and humid environments. The affixing mechanism 40 includes an adhesive layer 41 that is directly conjoined, without the use of intervening elements, to a bottom surface 38 of the second stationary disc 36B. Such an adhesive layer 41 has a peelable protective cover 42 attached thereto.

Referring to FIGS. 1, 2, 4A and 6, an identification marker 43 is adjustably connected to the date-identifying mechanism 30. Such an identification marker 43 is spaced from the affixing mechanism 40. The identification marker 43 is vital for indicating the desired month of a year while the annular opening 37 indicates the desired day of the same month.

Figure 8:
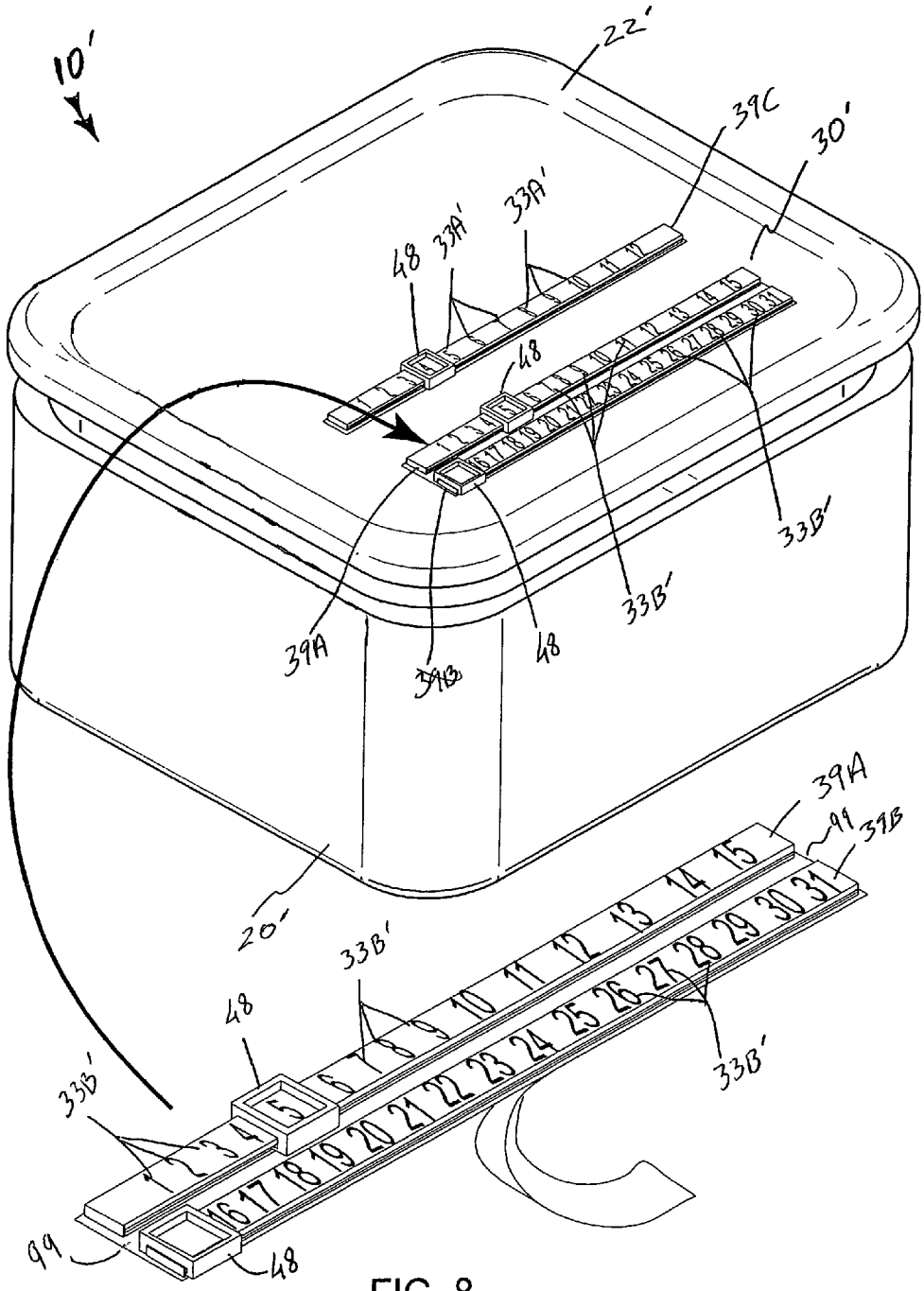
FIG. 8 is a perspective view showing an alternate embodiment of the date-identifying container for perishable food items, in accordance with the present invention.
Figure 9:
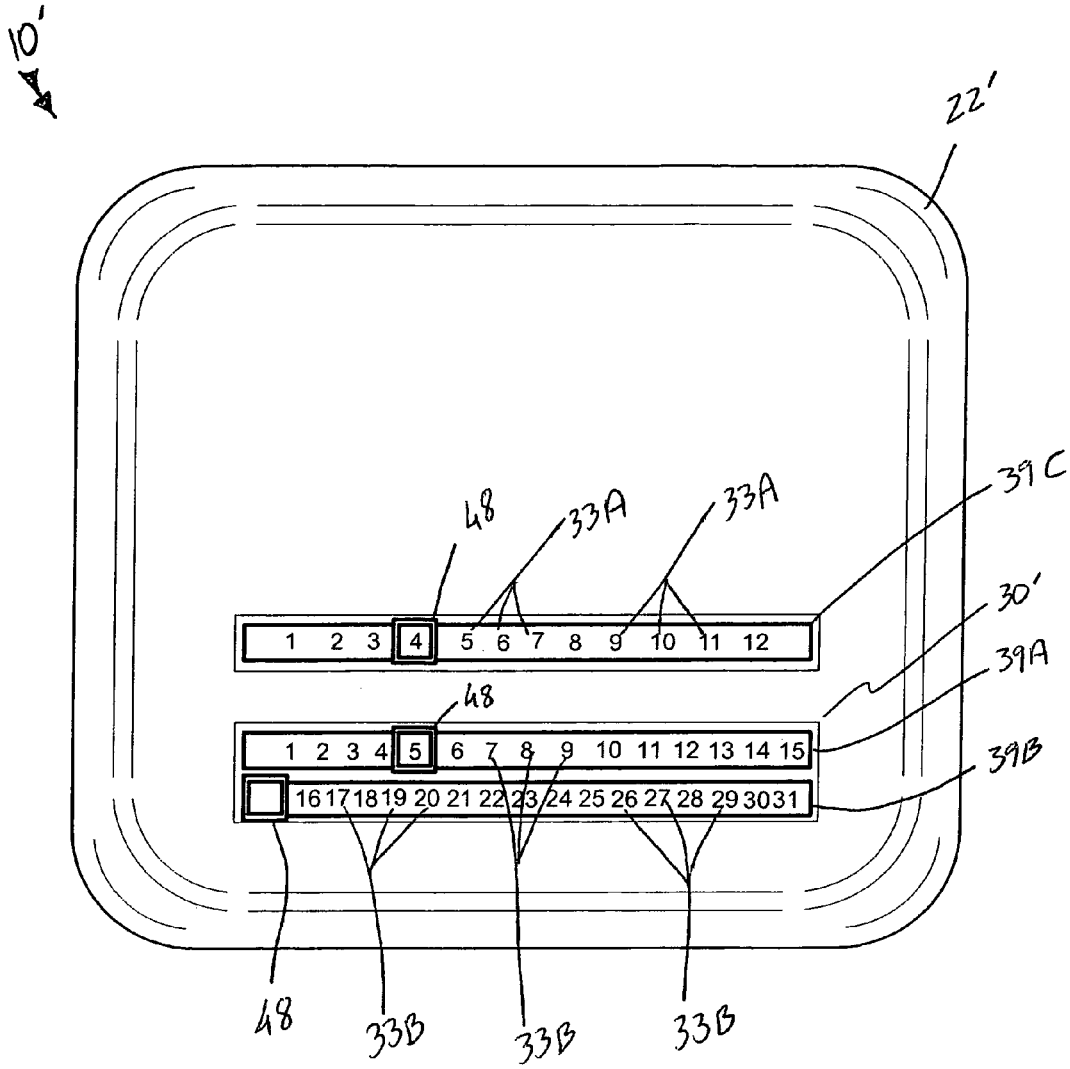
FIG. 9 is a top plan view of the apparatus shown in FIG. 8.

Referring to FIGS. 8 and 9, in an alternate embodiment 10', the date-identifying mechanism 30' includes first 39A and second 39B rectilinear bars that are juxtaposed side-by-side and extend across a major width of the lid 22' of the container 20'. Such first 39A and second 39B rectilinear bars have a plurality of numerals 33B' imprinted thereon in sequential order for effectively and conveniently identifying the days in a calendar month. A third rectilinear bar 39C is spaced from the first 39A and second 39B rectilinear bars. Such a third rectilinear bar 39C is directly conjoined, without the use of intervening elements, to the lid 22' and has a plurality of numerals 33A' imprinted thereon in sequential order for identifying the months in a calendar year. Each rectilinear bar 39 further has a identification window bracket 48 slidably attached thereto that is vital for allowing a user to isolate a desired month and a desired day on their respective rectilinear bars 39. Still referring to FIG. 8, a pair of stop members 99 may be provided for prohibiting the element 48 from laterally sliding off bar 39. Although only one embodiment of element 48 is shown in FIG. 8, the present invention may also include an alternate embodiment wherein element 48 lays flat along the bar 39 is suitable sized and shaped such that one embodiment of element 48 may transversely slide beneath another embodiment of elements 48 (currently shown in FIG. 8). Such an arrangement of elements 48 advantageously allows both elements to be positioned directly on a same number for identifying the month and day of the year. It is noted that the arrangement of numerical values assigned to the pair of bars 29 can be modified as desired by the user, without departing from the true scope and spirit of the invention.

Figure 10:
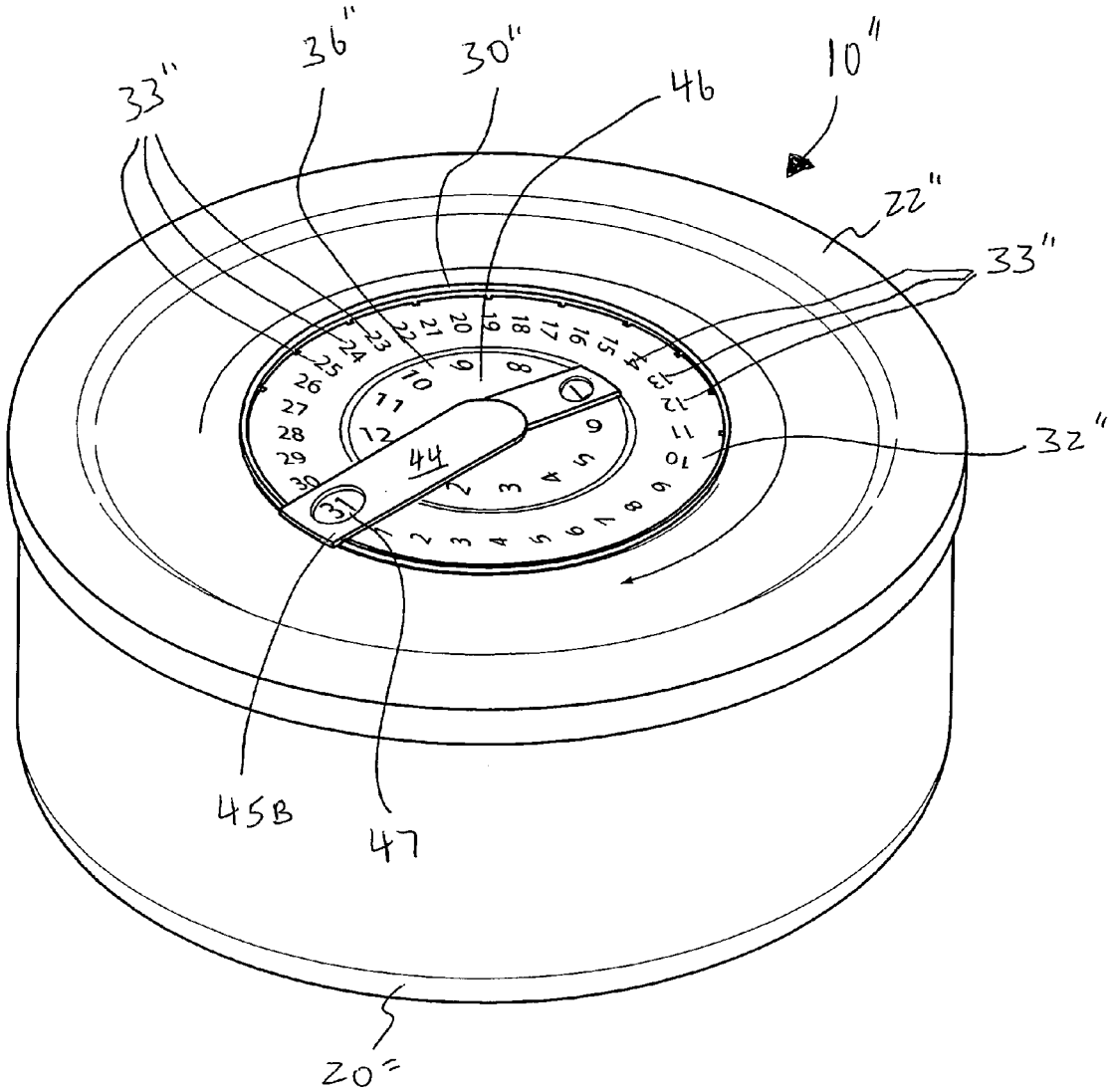
FIG. 10 is a perspective view showing yet another embodiment of the date-identifying container for perishable foods, in accordance with the present invention.

Referring to FIG. 10, in another alternate embodiment 10", the date identifying mechanism 30" includes a stationary disc 36" directly attached, without the use of intervening elements, to the lid 22" of the container 20". Such a stationary disc 36" includes an outer band 32" displaying numeric indicia 33" thereon in a sequential pattern ranging from the numerals 1-31. Each of the stationary disc numerals 33" identifies a day in a calendar month. A flat plank-shaped member 44 has opposed end portions 45, wherein one end portion 45A is rotatably attached to the top surface 46 of the stationary disc 36". Such a plank member 44 further has an annular opening 47 formed in another end portion 45B that is vital for isolating a desired numeral 33". Still referring to FIG. 10, such an embodiment may also include a raised edge extending about an exterior perimeter of element 30". Such a raised edge preferably includes a lip defining a track for the numerical values 33" such that such values can be easily rotated along the track. The top surface 46 may also be countersunk below the outer band 32' for also defining a track along which the stationary disc 36" is anchored. Thus, stationary disc 36" remains statically registered while the outer band 32" rotates along a respective track.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined container and date-notification mechanism for identifying a freshness date of a perishable food item stored within the container, said combined container and date-notification mechanism comprising:

a container having a body and a lid removably attached to said body for maintaining the perishable food item isolated from the environment;

means for identifying a date when the perishable food item is placed inside said body such that a user can quickly identify a number of days that the perishable food has been housed within said container without removing said lid from said body;

an identification marker adjustably connected to said date-identifying means; and means for removably affixing said date-identifying means onto said lid such that the user can selectively affix said date-identifying means onto alternate containers, said affixing means being formed from water insoluble material, wherein said identification marker is spaced from said affixing means;

wherein said date-identifying means comprises a first rotatable disc having an outer band displaying numeric indicia thereon in a sequential pattern ranging from the numerals 1-12, each of said numerals identifying a month in a calendar year;

a linear shaft having a top end directly and statically coupled to said first rotatable disc and protruding downwardly therefrom; and a second rotatable disc statically coupled directly to a bottom end of said shaft such that said second rotatable disc is disposed subjacent said first rotatable disc, said first and second rotatable discs rotating in sync when the user rotates said first rotatable disc, said second rotatable disc having an outer band displaying numeric indicia thereon in a sequential pattern ranging from the numerals 1-31, each of said second rotatable disc numerals identifying a day in a calendar month, wherein said second rotatable disc numerals are outwardly spaced from said first rotatable disc numerals such that the user can visually identify said first rotatable disc numerals and at least one second rotatable disc numerals from a top plan view.

* * * * *